US010400192B2

(12) United States Patent
Sloan

(10) Patent No.: US 10,400,192 B2
(45) Date of Patent: Sep. 3, 2019

(54) SYNTHETIC LUBRICANT, CLEANER AND PRESERVATIVE COMPOSITION, METHOD AND PRODUCT-BY-PROCESS FOR WEAPONS AND WEAPON SYSTEMS

(71) Applicant: BestLine International Research, Inc., Schenectady, NY (US)

(72) Inventor: Ronald J. Sloan, Blaine, WA (US)

(73) Assignee: Bestline International Research, Inc., Schenectady, NY (US)

( * ) Notice: Subject to any disclaimer, the term of this patent is extended or adjusted under 35 U.S.C. 154(b) by 0 days.

(21) Appl. No.: 15/597,414

(22) Filed: May 17, 2017

(65) Prior Publication Data

US 2017/0253828 A1 Sep. 7, 2017

(51) Int. Cl.

| | |
|---|---|
| ***C10M 159/06*** | (2006.01) |
| ***C10M 169/04*** | (2006.01) |
| ***C10M 105/18*** | (2006.01) |
| ***C10M 159/24*** | (2006.01) |

(52) U.S. Cl.

CPC ..... *C10M 159/06* (2013.01); *C10M 105/18* (2013.01); *C10M 159/24* (2013.01); *C10M 169/04* (2013.01); *C10M 2203/003* (2013.01); *C10M 2203/02* (2013.01); *C10M 2203/022* (2013.01); *C10M 2203/024* (2013.01); *C10M 2203/10* (2013.01); *C10M 2203/1006* (2013.01); *C10M 2203/1025* (2013.01); *C10M 2205/18* (2013.01); *C10M 2205/20* (2013.01); *C10M 2207/0406* (2013.01); *C10M 2211/00* (2013.01); *C10M 2213/062* (2013.01); *C10M 2219/044* (2013.01); *C10M 2219/046* (2013.01); *C10N 2230/04* (2013.01); *C10N 2230/06* (2013.01); *C10N 2230/12* (2013.01)

(58) Field of Classification Search

CPC ..... C10M 147/02; C10M 105/18; C10M 159/06; C10M 159/24; C10M 169/04; C10M 2203/003; C10M 2203/02; C10M 2203/022; C10M 2203/024; C10M 2203/10; C10M 2203/1006; C10M 2203/1025; C10M 2205/18; C10M 2205/20; C10M 2211/00; C10M 2213/062; C10M 2219/044; C10M 2219/046; C10N 2230/04; C10N 2230/06; C10N 2230/12

See application file for complete search history.

(56) References Cited

U.S. PATENT DOCUMENTS

| | | | | |
|---|---|---|---|---|
| 2,055,456 | A | 9/1936 | Eichwald | |
| 2,124,628 | A | 7/1938 | Moser | |
| 2,133,734 | A | 10/1938 | Moser | |
| 2,270,577 | A | 1/1942 | Bergstrom et al. | |
| 2,402,325 | A | 6/1946 | Greisinger et al. | |
| 2,418,894 | A | 4/1947 | McNab et al. | |
| 2,485,861 | A | 10/1949 | Sumner et al. | |
| 2,501,731 | A | 3/1950 | Mertes | |
| 2,721,846 | A * | 10/1955 | Lyons et al. | C10M 1/08 106/14.26 |
| 3,406,419 | A | 10/1968 | Young | |
| 3,480,550 | A | 11/1969 | Henderson | |
| 3,623,983 | A * | 11/1971 | Pattenden | C10M 1/08 252/389.2 |
| 3,984,599 | A | 10/1976 | Norton | |
| 4,127,491 | A | 11/1978 | Reick | |
| 4,131,551 | A | 12/1978 | Thompson et al. | |
| 4,218,330 | A | 8/1980 | Shubkin | |
| 4,224,170 | A | 9/1980 | Haugen | |
| 4,224,173 | A | 9/1980 | Reick | |
| 4,228,021 | A | 10/1980 | Lenack | |
| 4,261,840 | A | 4/1981 | Gragson | |
| 4,375,418 | A | 3/1983 | Zoleski et al. | |
| 4,387,033 | A | 6/1983 | Lenack et al. | |
| 4,443,348 | A | 4/1984 | Wright et al. | |
| 4,483,195 | A | 11/1984 | Brown et al. | |
| 4,504,404 | A | 3/1985 | Schumacher et al. | |
| 4,534,873 | A | 8/1985 | Clark | |
| 4,543,195 | A | 9/1985 | Grangette et al. | |
| 4,659,488 | A | 4/1987 | Vinci | |
| 4,844,825 | A | 7/1989 | Sloan | |
| 4,859,359 | A | 8/1989 | DeMatteo et al. | |
| 4,879,053 | A | 11/1989 | Matthews et al. | |

(Continued)

FOREIGN PATENT DOCUMENTS

| | | | |
|---|---|---|---|
| CA | 2496921 | A1 | 8/2006 |
| CN | 1209452 | A | 3/1999 |

(Continued)

OTHER PUBLICATIONS

Lubrizol, Alox 2100 Rust Preventive, retrieved from the internet at <http://web.archive.org/web/20120606013226/http://www.lubrizol.com:80/IndustrialAdditives/MetalworkingAdditives/Products/ALXO2100.html> on Dec. 21, 2018. (Year: 2012).*

(Continued)

*Primary Examiner* — James C Goloboy
(74) *Attorney, Agent, or Firm* — Jay R. Yablon

(57) ABSTRACT

A synthetic lubricant, cleaner and preservative composition and related methods for weapons and weapon systems, comprising: at least one isomer solvent; Alox 2100 calcium sulfonate; and at least one base oil selected from the base oil group consisting of: group I base oils; group II base oils; and group III base oils. Optional ingredients comprise mineral spirits, alpha-olefins, synthetic calcium sulfonates, fluoro-additives, and common moellen degras.

50 Claims, No Drawings

(56) References Cited

U.S. PATENT DOCUMENTS

| | | | |
|---|---|---|---|
| 4,946,510 | A | 8/1990 | Kinnebrew et al. |
| 4,956,122 | A | 9/1990 | Watts et al. |
| 5,013,463 | A | 5/1991 | Slama |
| 5,120,358 | A | 6/1992 | Pippett |
| 5,136,118 | A | 8/1992 | Buchanan et al. |
| 5,169,564 | A | 12/1992 | Gallacher et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,439,602 | A | 8/1995 | Eckard et al. |
| 5,505,867 | A | 4/1996 | Ritter |
| 5,578,235 | A | 11/1996 | Jao et al. |
| 5,631,211 | A | 5/1997 | Nakagawa et al. |
| 5,672,572 | A | 9/1997 | Araik et al. |
| 5,681,797 | A | 10/1997 | Lawate |
| 5,741,764 | A | 4/1998 | Patel et al. |
| 5,885,942 | A | 3/1999 | Zhang et al. |
| 5,888,281 | A | 3/1999 | Longo |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,323,162 | B1 | 11/2001 | Yasunori et al. |
| 6,413,916 | B1 | 7/2002 | Baumgart et al. |
| 6,551,967 | B2 | 4/2003 | King et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro |
| 6,962,895 | B2 | 11/2005 | Scharf et al. |
| 6,992,049 | B2 | 1/2006 | Deckman et al. |
| 7,018,960 | B2 | 3/2006 | Negoro et al. |
| 7,022,766 | B2 | 4/2006 | Okada et al. |
| 7,055,534 | B2 | 6/2006 | Goode et al. |
| 7,109,152 | B1 | 9/2006 | Corby et al. |
| 7,124,728 | B2 | 10/2006 | Carey et al. |
| 7,745,382 | B2 | 6/2010 | Sloan |
| 7,776,233 | B2 | 8/2010 | Arafat et al. |
| 7,931,704 | B2 | 4/2011 | Sloan |
| 8,022,020 | B2 | 9/2011 | Sloan |
| 8,039,424 | B2 | 10/2011 | Sloan |
| 8,062,388 | B2 * | 11/2011 | Sloan ..... C10L 1/143 44/324 |
| 8,071,513 | B2 | 12/2011 | Sloan |
| 8,071,522 | B2 | 12/2011 | Sloan |
| 8,168,572 | B2 | 5/2012 | Thoen et al. |
| 8,268,022 | B2 | 9/2012 | Sloan |
| 8,334,244 | B2 * | 12/2012 | Sloan ..... C10M 169/044 208/19 |
| 8,377,861 | B2 | 2/2013 | Sloan |
| 8,415,280 | B2 | 4/2013 | Sloan |
| 8,491,676 | B2 | 7/2013 | Sloan |
| 8,623,807 | B2 | 1/2014 | Sloan |
| 8,771,384 | B2 | 7/2014 | Sloan |
| 9,284,507 | B2 | 3/2016 | Sloan |
| 9,309,482 | B2 | 4/2016 | Sloan |
| 2001/0036906 | A1 | 11/2001 | Locke et al. |
| 2003/0040444 | A1 | 2/2003 | Garmier |
| 2003/0087769 | A1 | 5/2003 | Dituro et al. |
| 2004/0014613 | A1 | 1/2004 | Dituro et al. |
| 2004/0060229 | A1 | 4/2004 | Todd et al. |
| 2004/0077506 | A1 | 4/2004 | Arrowsmith et al. |
| 2004/0102335 | A1 | 5/2004 | Carrick et al. |
| 2006/0160708 | A1 | 7/2006 | Sloan |
| 2008/0182769 | A1 | 7/2008 | Sloan |
| 2008/0190014 | A1 | 8/2008 | Volkel et al. |
| 2010/0261626 | A1 | 10/2010 | Sloan |
| 2010/0269404 | A1 | 10/2010 | Sloan |
| 2010/0273687 | A1 | 10/2010 | Sloan |
| 2010/0273688 | A1 | 10/2010 | Sloan |
| 2011/0009301 | A1 | 1/2011 | Sloan |
| 2011/0015103 | A1 | 1/2011 | Sloan |
| 2011/0197499 | A1 | 8/2011 | Sloan |
| 2012/0035087 | A1 | 2/2012 | Sloan |
| 2012/0060410 | A1 | 3/2012 | Sloan |
| 2012/0077720 | A1 | 3/2012 | Sloan |
| 2012/0077724 | A1 | 3/2012 | Sloan |
| 2013/0157918 | A1 | 6/2013 | Sloan |
| 2013/0178403 | A1 | 7/2013 | Sloan |
| 2013/0298450 | A1 | 11/2013 | Sloan |
| 2014/0305030 | A1 | 10/2014 | Sloan |
| 2015/0247103 | A1 | 9/2015 | Sloan |
| 2016/0186082 | A1 | 6/2016 | Sloan |
| 2016/0222315 | A1 | 8/2016 | Sloan |

FOREIGN PATENT DOCUMENTS

| | | | |
|---|---|---|---|
| CN | 101805657 | A | 8/2010 |
| DE | 19723460 | A1 | 1/1998 |
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| EP | 2619292 | A2 | 7/2013 |
| FR | 2193080 | | 7/1972 |
| JP | 59204700 | | 11/1984 |
| JP | 07233001 | | 9/1995 |
| JP | 2001-271077 | A | 10/2001 |
| WO | 1997019153 | | 5/1997 |
| WO | 2002034867 | A1 | 5/2002 |
| WO | 2003064571 | A1 | 8/2003 |
| WO | 2006-015800 | A1 | 2/2006 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |
| WO | 2012-40153 | A2 | 3/2012 |
| WO | 2012-40153 | A3 | 3/2012 |

OTHER PUBLICATIONS

Rudnick, Leslie R., Ed., Synthetic Mineral Oils and Bio Based Lubricants: Chemistry and Technology, Taylor & Francis (2006).

Journal of Automotive Engineering, May 1, 2001, vol. 55, No. 5, pp. 67-72.

Journal of Automotive Engineering, May 1, 2001, vol. 55, No. 5, pp. 67-72, English translation of: p. 70, last paragraph; Figure 6 and 7.

Kioupis, L.I. ;Maginn, E.J., Molecular simulation of poly-{alpha}-olefin synthetic lubricants: Impact of molecular architecture on performance properties, Journal of Physical Chemistry B: Materials, Surfaces, Interfaces, amp Biophysical; Journal vol. 103; Journal Issue: 49; Dec. 9, 1999.

http://www.sasoltechdata.com/MSDS/SASOLAB_C12L.pdf.

United States Environmental Protection Agency, "Status Report, Chemical Activities," Third Edition, vol. I (Jun. 1982), cover page, pp. 21, 38, 201.

40 CFR 700 to 789, Revised as of Jul. 1, 2006. cover page, p. 52.

Leslie R. Rudnick, Lubricant Additives: Chemistry and Applications, section 17.4.6, p. 428 (2009).

Corrosion Inhibitors, http://www.chemtura.com/bu/v/indexjsp?vgnextoid=2e6aeaa547e9f010VgnVCM100000b70215acRCRD&vgnextchannel=2e6aeaa547e9f010VgnVCM100000b70215acRCRD, printed on Jan. 22, 2014.

Calcinate C-300CS, http://www.chemtura.com/bu/v/index.jsp?vgnextoid=851c81a7bfd01110VgnVCM1000008ed7010aRCRD&vgnextchannel=2e6aeaa547e9f010VgnVCM100000b70215acRCRD&vgnextfmt=default, printed on Jan. 22, 2014.

International search report dated May 11, 2016 for PCT/US16/15256, issued by the ISA/IL.

Applicant's reply dated Jan. 19, 2017 to an Informal Answer from the IPEA/IL.

International Preliminary Report on Patentability from the IPEA/IL, dated Feb. 28, 2017, finding that the subject matter of the claims in counterpart application PCT/US16/15256 are novel and involve an

(56) References Cited

OTHER PUBLICATIONS inventive step under PCT articles 33(2) and (3), including applicant's reply dated Feb. 17, 2017 to a second Informal Answer from the IPEA/IL.
https://en.wikipedia.org/wiki/Polyolefin#Properties, printed May 17, 2017.

* cited by examiner

SYNTHETIC LUBRICANT, CLEANER AND PRESERVATIVE COMPOSITION, METHOD AND PRODUCT-BY-PROCESS FOR WEAPONS AND WEAPON SYSTEMS

FIELD OF THE INVENTION

This invention relates to the latest technology in the development of a high-performance synthetic lubricant, cleaner and preservative for weapons and weapon systems.

BACKGROUND OF THE INVENTION

For weapons generally, and especially for weapons used by the military in a wide range of adverse and extreme conditions, it is very important protect the metal in these weapons from oxidization caused by powder residue while protecting the barrel and components from rust and corrosion caused by oxidation and harsh conditions including marine conditions, extreme hot and cold temperatures, and ambient particulates such as sand and dirt which can jam a weapon. Further, marine conditions take a heavy toll by pitting and rusting the barrels and components of modern guns of all sizes. The reduction of corrosion in saltwater conditions would be a major benefit to the navies and other seafaring armed forces of the world.

To clean and preserve weapons it is necessary to deal with corrosion and pitting caused by powder residue and moisture. These problem are even more serious when it comes to marine applications and constant subjection to salt water and salt misting. There are numerous products on the market that will keep a gun barrel shiny so long as it is removed from hostile conditions such as moisture and sand. Either or both of these can cause premature damage to the inner and outer barrel and components. Jamming of cartridges due to excessive moisture and foreign material such as dirt, salt and/or sand has been a real issue with the armed forces. All handlers of weapons are plagued with the same problems and their costly and sometime deadly consequences.

The seaborne military has suffered over the years from hostile marine conditions while armies have had to deal with mud and flying debris such as dirt and sand. Many lives have been lost even over the past decade due to jamming of a cartridge or clip due to sand and dirt or corrosion of the mechanical mechanisms. Current lubricants do not properly handle hostile elements such as sand, dirt, mud and salt water. The military is constantly seeking a "silver bullet" to preserve the useful life of its weapons to maximize performance while protecting the lives of its combatants. Of the many products developed and sold, few have demonstrated the ability to provide an all-in-one product that can clean weapons, provide a layer of oil which can resist hostile conditions, prevent the buildup of residue from the spent powder, and when needed, keep the weapon reliable for a long time without constant cleaning. While there are products that claim to offer one purposeful use, none have shown their ability to provide an all-in-one capability to do this job. All fall short of the claims that they do make.

It would be desirable to have available an all-purpose lubricant/cleaner that is resistant to fouling from gun powder residue, and resistant to hostile elements such as sand, dirt, mud and salt water, yielding an effective weapon which is easy to clean and maintain even in the most hostile conditions.

SUMMARY OF THE INVENTION

Disclosed herein is a synthetic lubricant, cleaner and preservative composition for weapons and weapon systems, and associated methods, comprising: at least one isomer solvent (as a carrier to move throughout the gun, and as a cleaning agent for residue over wide temperature range); Alox 2100 calcium sulfonate (for rust inhibition); mineral spirits (to dissolve the Alox when the Alox is not pre-heated during product manufacturing); and at least one based oil selected from the base oil group consisting of: group I base oils; group II base oils; and group III base oils (providing a film for lubrication).

This synthetic lubricant, cleaner and preservative for weapons and weapon systems has the capacity to protect metal surfaces against corrosion, while providing excellent lubrication properties. The lubricant actively penetrates the crystalline surface of the metal while exhibiting extreme pressure lubrication, and is non-migrating with lasting protection. The lubricant exhibits the ability to withstand salt water and powder flash residue without corrosion or restriction within the weapon barrel in reduce the speed or distance of the projectile, and without jamming.

This synthetic lubricant, cleaner and preservative composition and related methods for weapons and weapon systems, comprises: at least one isomer solvent; Alox 2100 calcium sulfonate; and at least one base oil selected from the base oil group consisting of: group I base oils; group II base oils; and group III base oils. Optional ingredients comprise mineral spirits, alpha-olefins, synthetic calcium sulfonates, fluoro-additives, and common moellen degras.

DETAILED DESCRIPTION

The invention is a high-performance synthetic lubricant, cleaner and preservative composition for weapons and weapon systems and associated methods of use and production that can be used to reduce metal oxidation caused by salt water, moisture and the reactive chemicals in powder discharge. Such oxidation creates carbon crystals that inhibit the discharge of additional rounds affecting the speed, distance and accuracy of the projectile, and the safety of the weapon.

This composition further has the ability to penetrate into the crystalline surface of the metal leaving a lubricating film which is resistant to future corrosion brought on by harsh conditions from marine, desert or other similarly-problematic environments. Further, the lubricant leaves a barrier film which has extreme pressure capacity, and acts as a solvent to remove residue from the spent powder while preventing oxidation of the metal inside and outside the bore. Although the lubricant cleans the weapons or weapon systems thoroughly, it leaves behind a lubricating film that speeds the projectile while protecting the metal from oxidation and the collection of carbon residue from the spent powder. The product has valuable uses from short barrel handguns to the large barrels of naval ships.

Primary Ingredients

The finished product/composition, in a preferred embodiment of the invention, is a novel and inventive (nonobvious) combination, as a whole, of the following primary ingredients (elements):

At least one isomer solvent: Such solvents include but are not limited to dipropylene glycol n-propyl ether, tripropylene glycol methyl ether, triethylene glycol monoethyl ether, diethylene glycol methyl ether, dipropylene glycol n-butyl ether, DE and DP solvents, 2 propoxyethyl ethanol, diethylene glycol monoethyl ether, 2 butoxyethyl acetate, cellosolve carbitol, glycol phenyl ether, 2 ethylhexyl acetate. These isomer solvents are essential to this composition because they have a very high Flash Point of 100 degrees C.

(ASTM D 93) or greater and a freezing point of minus 60 degrees C. (ASTM D 97) or lower. This wide temperature range is required especially for a military applications involving ambient temperatures ranging from arctic conditions to the extreme heat of deserts. Additionally, isomer solvents are very polar, with slow evaporation rates, which means that after they are applied to a weapon their effects will be longer lasting. Mineral spirits often employed in the prior art, in contrast, typically have an approximate flash point of 85 degrees C. (ASTM D 93) or lower and an approximate freezing point of minus 50 degrees C. (ASTM D 97) or higher.

Isomer solvents are commonly used as cleaning solvents, in aerosols, paints, inks, varnishes and paint thinners for household and commercial use. These have an API Gravity of 0.965 to 0.999 according to ASTM D-4052, an aniline point of 60 to 85 degrees C. according to ASTM D 611, a vapor density at 15 degrees C. (ASTM D 4052) kg/L with an average value of approximately 0.750 to 0.850, a boiling point of about 150 degrees C. (OECD Test Guideline 103) and greater, and a freezing point from minus 78 to minus 60 degrees C. according to ASTM D 97.

Alox 2100 Calcium Sulfonate(s):

This is a particular type of calcium sulfonate (calcium soap). Under this name it is manufactured by Lubrizol Corporation, though the use of any equivalent product under a different name is regarded to be within the scope of this disclosure and its associated claims. This has a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446). Alox 2100 calcium sulfonates are often used as a stabilizer for the rheological control of finished products. Alox 2100 at ambient/room temperature is a solid waxy material that requires preheating before blending. Once heated Alox 2100 can be blended with a mineral spirit to render it into a stable solution at ambient temperature after the blend is cooled.

Mineral Spirits:

This is a primary ingredient, but as will be discussed, it may be omitted when the overall composition is produced by blending at high temperatures. While any mineral spirit may be employed, it is preferred to use a mineral spirit with a high flash point and a low viscosity, with low aromatic content and a mild odor. These should exhibit a high boiling point to meet the Volatile Organic Compound (VOC) as established by CARB (California Air Resource Board) Consumer Product Regulators, and in the US EPA's National Volatile Organic Compound Emissions Standards for Consumer Products or LVP-VOC solvents such as CAS 64742-96-7. These mineral spirits should preferably have low volatility (lower than 250 degrees C. (482 degrees F.)) according to ASTM D 3960, and should have a pour point of greater than minus 40 and even minus 59 degrees C. or lower according to ASTM D 97.

Preferably, these mineral spirits comprise a colorless homogeneous solution with low odor and low aromatic, with an evaporation rate of approximately 0.01 (n-butyl acetate=1 according to ASTM D 3539), which is common for petroleum distillates that have been synthesized from selected hydrocarbons. The mineral spirits which may include Stoddard's Solvents, are subject to hydro-desulfurization solvent extraction with a mixture of saturated aliphatic and alicyclic C7-C12 with a maximum of 40%. The flash point preferably ranges from 60 to 90 degrees C. according to ASTM D-93, with API Gravity of 0.800 to 0.885 according to ASTM D-4052, an aniline point of 60 to 85 degrees C. according to ASTM D 611, a density at 15 degrees C. kg/L of an average value of approximately 0.750 to 0.850 according to ASTM D 4053, and a boiling point of 150 degrees C. (OECD Test Guideline 103) or greater and a freezing point of minus 40 degrees C. to minus 78 degrees C. or lower according ASTM-D 97.

As will be detailed below, mineral spirits are a required ingredient only if the blending with the other primary ingredients is carried out without preheating; otherwise they are optional. If the blending process uses heat, then the mineral spirits may be omitted entirely, because the Alox 2100 will remain in solution with the isomer solvent(s) and the base oil (discussed momentarily) after the entire composition is cooled to ambient temperature.

At Least One Base Oil:

The final primary ingredient is at least one based oil selected from the base oil group consisting of: group I base oils which are solvent-refined mineral oil; group II base oils which are more-refined solvent-refined mineral oils; and group III base oils which are severe hydrocracked or processed through hydroisomerization wax conversion. These base oils are either solvent refined, or severe hydro-cracked or hydroisomerized base oils with low or no aromatics and impurities achieved by chemically reacting the feedstock with hydrogen (3000 P.S.I.) to reduce or remove polar compounds containing sulfur, nitrogen and oxygen and to convert aromatic hydrocarbons to saturated cyclic hydrocarbons breaking up the heavy polycyclic-paraffin molecules to light saturated hydrocarbons. This may include fractionated oils that have been hydro-finished or hydro-polished. The base oils are of the types used in a host of lubricating oils, motor oils, cutting oils, food processing, coatings, pharmaceuticals, and industrial and agricultural lubricants and extreme pressure additives.

Combined Composition:

As to the composition as a whole which is a combination of the foregoing primary ingredients, the isomer solvent when blended with the Alox 2100 provides a salt spray resistant film that has the ability to clean the metal and encapsulate the other components of the formulation to the surface of the metal providing an oxidation barrier. This coating leaves a long-lasting film of protection from moisture and hostile chemicals such as flash powder residue. This is most important for weapons ranging from small arms to large howitzers and large naval guns. Alox is a calcium-based rust preventive additive that is soluble in solvents including the groups I, II and III base oils. Alox 2100 is free of barium and heavy metals, which is important for cleaning and protecting gun components, especially the inside of the barrel. Alox 2100 when blended with the base oil has the capability of exceeding the 96 hour standard in a salt spray environment as measured by ASTM B 117-11. Further Alox 2100 does not rely upon a thick or layered hard-to-remove film which film is undesirable for providing protection to small and large firearms.

In the combination as a whole of the overall composition, the isomer solvents work as a cleaning agent while establishing the wide temperature range of utility required for the conditions encountered by the military. They also act as an effective carrier for the entire composition. The Alox 2100 inhibits the formation of rust and so is an anti-corrosion preservative. The purpose of the mineral spirits is merely to dissolve and/or keep dissolved the Alox 2100 in solution when a means of preheating the Alox is unavailable or is not employed. As mentioned above, and as will be elaborated when the blending process is discussed, if preheating is used, then the mineral spirits become an unnecessary ingredient, because the Alox 2100 will remain in solution with the isomer solvent(s) and the base oil after the entire composition is cooled to ambient temperature, and will remain so until at least minus 60 degrees C. Finally, the group I, II and/or III base oils form a positive film for overall lubrication. The isomer solvents, as noted, are also an effective carrier to deliver the entire composition to all of the desired surfaces of the weapon. The composition as a whole is capable of providing a stable cleaning agent with wide-temperature ranges, while delivering the anti-corrosion benefits of the Alox 2100 and the lubricating benefits of the base oils to the desired surfaces of the weapon.

Other Ingredients

Other desirable, albeit optional ingredients (elements) include the following, individually and in varying combinations:

Alpha-Olefins:

These are alternatively known as alkenes, polymerized olefins, alpha olefins, M PAO's, chlorowax waxes, and chlorinated very-long carbon chain alkanes. Poly-alpha-olefin (or poly-α-olefin or polyalphaolefin, sometimes abbreviated as PAO) is a polymer made by polymerizing an alpha-olefin. Poly-alpha-olefin is a fully synthesized hydrogenated hydrocarbon base fluid produced from linear alpha-olefin feed stocks. Its engineered physical and performance properties are designed to extend or enhance the performance of a fully-formulated lubricant, i.e., to keep that lubricant effectively performing for a longer period of time. An alpha-olefin (or α-olefin) is an alkene where the carbon-carbon double bond starts at the α-carbon atom, i.e. the double bond is between the #1 and #2 carbons in the molecule. Alpha-olefins such as 1-hexene may be used as co-monomers to give an alkyl branched polymer, although 1-decene is most commonly used for lubricant base stocks. The chemical structure, as shown in https://en.wikipedia.org/wiki/Polyolefin#Properties which is hereby incorporated by reference, is:

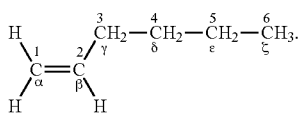

Preferably, the carbon chain length is 20-plus, with a Carbon Number weight percentage of C-18, C-20, C-22, C-24, C-26, C-28 and C-30 according to test method GLC and a typical value from 0.00 to 80.3. Further, alpha-olefins produced through chlorination should have a long or very-long carbon number preferably greater than 21 with chloric or chlorination weight percentage from 21.4% to 50%, an HCl of 4 to 10 ppm and molecular weight of 200 to 650 and Wt. Cl (2) from 20 to 50% with specific gravity at 25 degrees C. of 1.050 to 1.50 ASTM D 4052 and a JQD weight percentage of HCL being 0.20 to 0.50 percent maximum or 2 to 15 ppm and a viscosity 10-25 poise according to ASTM D 445 at 25 degrees C. Likewise, the carbon chains can include long and very-long chains of C18 and greater. Alpha-olefins are often used in lubricant formulations, lubricant additive compounds, coatings, extreme-pressure additive formulations and for metal-working compounds. Polymerized alpha-olefins are the most advanced synthetic alpha-olefins known in the art today, and are understood to include any future improvements that may be made to advance the state of the art for synthetic alpha-olefins.

An optional albeit desirable ingredient in the composition of this invention, alpha-olefins are used to provide long-term lubrication, beyond the effective period of lubrication provided by the group I, II and/or III base oils. When the composition including the alpha-olefins is applied to a weapon, then even if the weapon was subjected to salt water for several weeks or was idle for months without proper cleaning following combat use, the weapon can be placed back into action without fear of failure or jamming. The mechanical components that have been thoroughly treated with this composition including alpha-olefins, will retain a protective barrier of lubrication while the inside of the barrel maintains a layer of protection allowing quick effortless cleaning prior to the weapon going back into action. The ability of the finished composition including alpha-olefins to adhere to the metal or composition material while resisting the adhesion of sand or dirt along with resisting salt and corrosion keeps the weapon fully functional without any further application of this compound for months or even years.

In contrast, the lubricating effects of group I, II or III base oils is reduced by the base oils' own water which is a destructive contaminant. The water attacks the base oil additives, induces base oil oxidation and interferes with oil film production. Adding the effects of salt, acids from the soil or residue from spent powder, the base oils will only provide protection measured in hours, and not days or weeks or months let alone years. Base oils especially of groups I and II, and also group III, are unable to meet the conditions (100 hours without corrosion) of the salt water test according to ASTM B 117-11. This is proved by tests of existing products which do rely on just a base oil as a lubricant.

Synthetic Calcium Sulfonates:

These are over-based calcium sulfonates with a Total Base Number (TBN) of 100 to 600. These are often used in extreme pressure additive formulations offering corrosion protection, dispersant and detergent in oil-soluble additives for ferrous and non-ferrous metals. These have a minimum calcium weight of 10.00 to 20.00%, a total base number in mg KOH/g (ASTM D-2896) of 100 to 600 and an average molecular weight (ASTM D-3712) of 800 to 1200. As part of the composition of this invention, because synthetic calcium sulfonate is not a waxy substance like the Alox 2100, it has the ability to migrate into the deepest depths of the austenitic surface of the metal to reduce the potential for subsurface oxidation of the metal. Although this area is not seen by the naked eye, it is often the area where oxidation of metal is most destructive.

Polytetrafluoroethylene, (Tetrafluoroethylene Oligomer) (Fluoro-Additive):

CAS No 9002-84-0. Fluoro-additives are organic polymers in colloidal form that when blended into a solvent base compound and applied are highly resistant to water or weathering conditions. These have a viscosity of 400 cP @ 25 degrees C., ASTM D 445, and a Flash Point of approximately 196 degrees C., ASTM D 93. As part of the composition of this invention, this component adds one more layer as a barrier against calcium chloride/salt solutions and other earth contaminants being able to penetrate the austenitic surface of the metal. In this way, the fluoro-additive provides one more layer of long-term protection. It is preferred to use a liquefied fluoro-additive, but it is possible within the scope of the invention to use fluoro-additive powders of various micron sizes.

Common Moellen Degras:

CAS 8020-84-6, EINECS Number 232-418-6, Density 0.94-0.97 ASTM D 4052, Free Fatty Acid 15-30%, Iodine Value 20-40, Melting point 35-49 degrees C., Flash point 440-470 degrees C. ASTM D 93. Similarly to the synthetic calcium sulfonate and polytetrafluoroethylene, the common moellen degras can be blended into the composition of the invention to provide long-term corrosion protection and lubrication, far beyond the effective period of lubrication provided by the groups I, II and/or III base oils often relied upon by other United States Mil Spec lubricants. This added protection is especially important for weapons which are in storage or idle for long periods of time.

Preferred Blending Ratios

The preferred blending ratios for each of the previously-described ingredients are shown below:

Isomer Solvents:

30 to 95 percent by volume and preferably 40 to 80 percent by volume and more preferably 55 to 75 percent by volume. Most preferable is 62 percent by volume.

Alox 2100 Calcium Sulfonate:

5 to 65 percent by volume and preferably 6 to 45 percent by volume and more preferably 7 to 30 percent by volume. Most preferable is 7.5 percent by volume.

Mineral Spirits:

2 to 25 percent by volume and preferably 3 to 15 volume percent and more preferably 5.5 to 7.5 percent by volume. Most preferable is 6 percent by volume.

Base Oils:

5 to 55 percent by volume and preferably 7 to 42 volume percent and more preferably 8 to 35 percent by volume. Most preferable is 9 percent by volume.

Alpha-Olefins:

2 to 30 percent by volume and preferably 5.5 to 22 percent by volume and more preferably 6.5 to 17 percent by volume. Most preferable is 10.25 percent by volume.

Synthetic Calcium Sulfonates:

0.20 to 15 percent by volume, preferably 0.50 to 10 percent by volume and more preferably 0.65 to 6 percent by volume. Most preferable is 1.25 percent by volume.

Polytetrafluoroethylene/Fluoro-Additive:

0.10 to 2.0 percent by volume and preferably 0.102 to 1.99 percent by volume and more preferably 0.35 to 0.75 percent by volume. Most preferable is 0.50 percent by volume.

Common Moellen Degras:

0.50 to 30 percent by volume and preferably 2 to 20 percent by volume and more preferably 2.5 to 10 percent by volume. Most preferable is 3.5 percent by volume.

The "most preferable" percentages listed above for all of the ingredients sum to 100%. Given that the isomer solvent, the Alox 2100 and the base oil are the only ingredients which are required in all formulations of the composition of the invention, and that all other ingredients are optional, in the event one or more of the ingredients shown above is omitted from the synthetic lubricant, cleaner and preservative for weapons and weapon systems of this invention, the percentages by weight of the remaining ingredients are proportionately increased so that the "most preferable" percentages still sum to 100%.

Preferred Sequence of Blending Components

In a first preferred method which does not use the mineral spirits but consequently does require preheating, the Alox 2100 is preheated to 40 to 50 degrees C. This can be done by means of, e.g., heat bands or a hot room. At the same time, the isomer solvent is preheated to approximately 40 degrees C. The Alox and the isomer solvent are then blended together into a primary blend until the combined liquid is in a consistent amalgamation without any appearance of separation. If the alpha olefins are omitted, then the base oil(s) is/are preheated to about 30 degrees C. and added to the primary blend and the liquid is agitated/blended until the combined blend is a consistent amalgamation without appearance of separation. If the alpha-olefins are included, a secondary blend is prepared by mixing the base oil and the alpha olefins, both preheated to 30 degrees C., until the combined blend is a consistent amalgamation without appearance of separation. The secondary blend is then added to the primary blend and the liquid is agitated/blended until the primary and secondary blend form a consistent amalgamation without appearance of separation. Then the primary and secondary blends are combined to produce the final blend (of the required ingredients), and the blending may be completed at ambient temperatures. This process of blending and agitation of the primary and secondary blend may take 2 to 4 hours depending on the ambient temperature and the speed of the agitator.

In a second preferred method which minimizes the need for preheating but consequently does require using mineral spirits, the Alox 2100 is again preheated to 40 to 50 degrees C. by, e.g., heat bands or a hot room. Further, the mineral spirits are preheated to about 30 degrees C. and blended with the preheated Alox 2100 until these form an amalgamation without any appearance of separation. This amalgamation can now be lowered to ambient temperature for future blending without the aid of further preheating, and the rest of the blending with the isomer solvent(s) and the at least one base oil takes place as described in the previous paragraph, but without any further preheating being required.

As noted earlier, the mineral spirits are only required if the Alox 2100 is being combined with the isomer solvent(s) and the base oil(s) at room temperature. In the higher-temperature alternative method, all of the isomer solvent(s), the base oil(s) and the Alox 2100 are blended together at a temperature ranging from 40 to 50 degrees C. No mineral spirits are required in this method. This blend may then be cooled down and will remain operational, in liquid form, down to temperatures of minus 60 degrees C. or lower.

As to other (optional) ingredients if used, the common degras and/or synthetic calcium sulfonates are blended with the (aliphatic) mineral spirits to dissolve them to an amalgamation solution prior to their being blended with the primary and secondary blend i.e., with the final blend of the required ingredients. The common degras requires preheating to 40 degrees C. with e.g., electric bands or a dedicated hot room. The mineral spirits at a 1-to-1 mix blend and reduce the viscosity of both the synthetic calcium sulfonates and/or the common degras so that they will blend thoroughly with the primary and secondary blend to form an amalgamation without the appearance of separation. In this case, the additional mineral spirits are not required if the common degras and/or the synthetic calcium sulfonates are not added to the primary and secondary blend.

Once the primary and secondary blend is completed and blended with any of the optional ingredients, the entire composition is then sheared through a homogenizer at approximately 3600 RPM until the blend has been circulated through the pump for a minimum of 4 cycles based on the volume of the blend and the gallons per minute necessary to produce a homogenous solution. This final shearing ensures a long stable shelf life of three years or more for the finished product, without separation.

Adding the common degras, polytetrafluoroethylene and the synthetic calcium sulfonates to the primary and secondary blend more than doubles the active life of the product while substantially increasing the lubrication factor for the weapon. The blending of the common degras with the alpha olefins of the secondary blend provides the extreme pressure anti-wear factor of the finished product.

Once blended into a viscous stable solution, the resulting weapon cleaning solution is ready to be applied to weapons ranging from to handguns to larger-bore weapons such as tank, howitzers and naval guns, to provide a layer of protection and lubrication against the elements. The blended product is useful for protecting weapons ranging from rapid-fire small arms to the larger naval anti-aircraft guns such as the revolutionary hydraulically driven GAU-8 Gatling guns with a firing capacity of over 4000 (30 mm) rounds per minute. With rapid fire comes heat which in the salt air causes the formation of moisture as the guns cool. This salt air is known to rapidly attack the barrels and the working components if the are not cleaned immediately. Once treated with the composition of the invention, the barrels will remain protected from these elements throughout the rapid firing.

Preferred Blend Equipment

The process sequence involves a series of blending and holding tanks where the product can be weighed and then pumped through control valves to maintain consistent flow and pressure, in the desired blending ratios previously disclosed. The blending should be performed in an enclosed tank to reduce product evaporation (loss) and prevent exposure to open spark. Blending equipment can be by a combination of high or low speed blending apparatuses. Size or volume of tank is not critical to the blend. The final stage of the blending process is shear-induced mixing by running the blend through a shear pump for at least four cycles for 3-6 hours at 3600 rpm to completely shear or homogenize the liquid, to ensure the liquid components will remain in a stable blend for three years or longer.

Multifunctional Use of Invention

The composition of this invention can be used to clean all types of weapons and weapon systems, and has been experimentally tested in various extreme conditions, including range and salt water testing. It can also be used for cleaning and lubricating weapons for long- or short-term storage and/or for operating in harsh conditions such as salt water, sand, mud and dirt. This composition has been experimentally tested as an extreme-pressure topical lubricant and has exceeded the performance of other available lubricants. Finally this composition has been experimentally tested in situations where there is severe salt water exposure causing rust and corrosion susceptibility, and has demonstrated the ability to penetrate the austenitic surface of the metal and provide a barrier resistant to salt and corrosion. The composition in experimental testing has shown its ability to work well with ferrous and non-ferrous material with profoundly-positive results.

Testing Procedures and Results

This lubricant is unique in its field and has such has been tested on the Timken Bench Tester and has shown that it has the capacity to exceed the lubrication capacity of any prior art gun cleaner/lubricant or topical lubricants many times over. When tested, typical prior art gun cleaner/lubricants failed at 3 to 7 foot-pounds and typical topical spray lubricants failed at less than 2 foot-pounds. This lubricant cleaner as described in this disclosure exceeded 40 foot-pounds of destructive weight. Further other gun lubricants failed to meet the 100 hour salt water spray test according ASTM B 117-11.

There are a number of ASTM D tests to rate the effectiveness of the finished product including but not limited to ASTM B117-11, Operating Salt Spray for 100 hours, ASTM B152 and 152M Copper strip and sheet test, ASTM D 56 Flash Point by Tag Closed Cup and ASTM D 92 Flash Point by Cleveland Open Cup. Further tests include ASTM D 97, Pour Point, ASTM D 4172 Wear Preventive Characteristics of a lubricant and ASTM D 972 for the evaporation loss of lubricating oils. Beyond the laboratory testing, field tests are critical to putting the product to use under conditions where weapons or weapons system are prone to failure.

Experimental Evaluation

The following examples demonstrate the capability of the invention when put to experimental tests on the range. Further testing included wear and weld testing when compared to off-the-shelf prior art weapon lubricants and two of the key test parameters of MIL Spec PRF 63460E with Amendment 4. The comparison was made again the leading Gun Oil that has acquired a United States Mil Spec, namely G96 Gun Oil.

Range Evaluation of the Lubricant, Cleaner and Preservative: The evaluations were conducted using both handguns and automatic rifles. Each pistol or revolver was fired a minimum of 750 rounds per month for seven months totaling over 17,500 rounds fired from a Glock 22, Smith and Wesson M/P 9, and a Beretta 92. There were no (zero) malfunctions whatsoever due to loss of lubricity or fouling. The pistols fired smoothly and without malfunction for well over 5500 rounds each. When cleaned with this composition it was found that there was very little residue from the spent powder in the barrel compared to earlier firing with less than half the number of rounds being fired. During firing at an outdoor range, clips were purposely dropped on to the ground to see if the cleaner and lubricant would retain any residual dirt and/or sand that could interfere in the firing, and there were no such issues with the clips. Normally in such situations the clips have to be unloaded of their round and the clip thoroughly cleaned before reloading the rounds. Further, the clips are known to retain dirt and sand making them difficult to reload into the weapon once dropped. No such problems were recorded. When compared to similar tests conducted with approved gun cleaners and lubricants, the test with this composition completely outperformed leading products on the ranges where for the other products there was substantial barrel residue and a number of jamming problems.

The evaluation also included six newly-purchased M16 rifles. The test was conducted over a ten-day period with each rifle firing 500 rounds of military spec ammunition per day, with a total of 30,000 rounds expended. No malfunctions (zero malfunctions) of any kind involving lubricity or fouling were encountered during the evaluation of the lubricant. Further, the shooters found that if they disassembled their firearms, cleaned them with a degreaser or Windex with ammonia, and then applied the composition of the invention as per instructions, the pistols and rifles functioned flawlessly and were much easier to clean, and keep clean, as there was significantly less buildup of dirt and after-flash gunpowder fouling. Once again the composition of this invention outperformed off-the-shelf gun lubricants for which the guns sustained substantial barrel residue and jamming of clips that had been exposed to dirt.

Through mechanical testing, the lubricant was evaluated to measure its lubricating effect on friction, heat and wear. On average, the product demonstrated an ability to reduce friction and heat by well over 25%. This substantial reduction in friction can have a profound effect on maintaining the accuracy of automatic weapons.

Effective Lubrication Valuation:
ASTM-D Load Test:

| | |
|---|---|
| ASTM-D 2783 | Standard Test Method for Extreme Pressure Properties |
| ASTM-D 4172 | Standard Test Method for Wear Test Properties |

The 4-ball wear or weld tester reviewed below consists of 4 balls arranged in the form of an equilateral tetrahedron. The basic elements are three lower balls held immovable in a clamp to form a cradle, while the fourth ball is caused to rotate about a vertical axis under prescribed conditions of load, speed and temperature. 10 ml of the lubricant sample was placed in the ball pot and, after the test was completed, the wear scar diameter was measured for length and width on each of the three balls. The spinning ball was not measured. Pressure exerted upon the balls was measured in KgF. (Kilogram Force). These tests, although extreme, reflect the lubrication advantage with both the moving parts of various types of arms and the ability of the lubricant to withstand the extremes of heat and pressure within a firearm upon firing. The following were the lubrication test results for the ASTM-D 2782 Extreme Pressure Test:
ASTM-D 2782 Extreme Pressure Test:
With the Composition of the Present Invention:

| Ball No. | Load | Time-sec | Temp | Length Test Scar | Width Test Scar |
|---|---|---|---|---|---|
| 1 | 150 KgF | 10.2 | Ambient | 1.28 mm | 1.74 mm |
| 2 | 150 KgF | 10.2 | Ambient | 1.36 mm | 1.62 mm |
| 3 | 150 KgF | 10.2 | Ambient | 1.30 mm | 2.01 mm |
| Average | | | | 1.31 mm | 1.79 mm |

With Prior Art Compositions:

| Ball No. | Load | Time-sec | Temp | Length Test Scar | Width Test Scar |
|---|---|---|---|---|---|
| 1 | 150 KgF | 10.1 | Ambient | 5.0 mm | 5.0 mm |
| 2 | 150 KgF | 10.1 | Ambient | 5.0 mm | 5.0 mm |
| 3 | 150 KgF | 10.1 | Ambient | 5.0 mm | 5.0 mm |
| Average | | | | 5.0 mm | 5.0 mm |

Notes:
KgF (Kilogram Force = Load)

The speeds of the rotating balls mentioned above were 1725 rpm.

The prior art compositions were off-the-shelf gun lubricants. Samples were collected and tested for their ability to withstand extreme pressure and wear. After bench testing the products, a product was picked that demonstrated the best lubrication properties to compete with the present invention. The competitive products were not tested on the range; there are many published results available for them, many of which are on the internet. Range reports on the various products which are cleaners relying upon solvents (mineral or citrus based) as the main component appear to demonstrate similar results to one another, but all lacked lasting lubrication protection.

Further a sample of the leading gun oil used by the United States military, G96 Gun Oil with a current United States Mil Spec PRF 63460E, was sent to the military-approved lab for salt spray testing according to ASTM B 117-11. This is a critical test for both the marines and the navy. After 100 hours of continuous salt spray, the blanks were completely oxidized with a heavy layer of corrosion. Looking at a blank, would be obvious that a weapon in such condition would not be in working condition and would certainly place a soldier's life at risk. Likewise, when the composition of this invention was subjected to the same test ASTM B 117-11 at 100 hours, the metal blanks were free of any oxidization. Further, weapons subjected to salt spray test should remain in good operating condition. This is critical to the soldier in the field, the marine in the foulest conditions or the navy soldier having to deal with continuous salt air and salt spray conditions.

Even without optional use of alpha-olefins which as mentioned earlier extend the length of time that the weapons remain properly lubricated, the composition of this invention substantially outperformed G96 in salt spray testing. This result is very important to the military.

Weld: This is the word used to describe the "scar" formed by metal deformation. The use of this term means that metal was torn off of the fixed three balls in the cup by the center spinning ball. The scar on the three fixed balls is measured for width and length. According to ASTM-D 4172 test, a scar size of 4 mm or greater on the stationary balls is considered a "weld" and total failure.

ASTM: This refers to the American Society for Testing and Materials, an organization that creates test protocols that are recognized internationally.

| Four Ball Wear Test ASTM-D 4172 | Speed | 1725 RPM: |
|---|---|---|

With the Composition of the Present Invention:

| Ball No. | Load | Time-sec | Temp | Length Test Scar | Width Test Scar |
|---|---|---|---|---|---|
| 1 | 28 KgF | 1.0 hours | Ambient | 0.429 | 0.429 |
| 2 | 28 KgF | 1.0 hours | Ambient | 0.429 | 0.429 |
| 3 | 28 KgF | 1.0 hours | Ambient | 0.429 | 0.429 |
| Average | | | | 0.429 | 0.429 |

With Prior Art Compositions:

| Ball No. | Load | Time-sec | Temp | Length Test Scar | Width Test Scar |
|---|---|---|---|---|---|
| 1 | 28 KgF | 1.0 hours | Ambient | 1.286 | 0.857 |
| 2 | 28 KgF | 1.0 hours | Ambient | 1.286 | 0.857 |
| 3 | 28 KgF | 1.0 hours | Ambient | 1.286 | 0.857 |
| Average | | | | 1.286 | 0.857 |

Note:
Tests were run with both Seta Shell Balls and SKF- certified balls. There was a slight variance between Seta Shell Balls and SKF balls 4719 Steel, Rockwell 60-64. Test balls conform to ASTM D 2266, ASTM D 2596, ASTM D 2783 and ASTM-D- 4172.

Lab. No. PLTL 16021005
Testing Per Mil-PRF-63460 E with Amendment 4

| Test Method | Description | Results |
|---|---|---|
| ASTM-B 117 | Salt spray Resistance 100 Hours | No Rust on any Panel |
| ASTM-D97 | Pour Point (minus 59 degrees C. max) | >minus 60 degrees C. |

This testing has demonstrated the ability of the invention to yield dramatic improvement over the prior art. Based this, the product shows the clear potential of exhibiting positive results in areas yet to be considered.

While formulating and optimizing the invention during experimental testing, it was found that the percentages of ingredients disclosed earlier are important. Many samples were tested to meet the ASTM B117-11 and other tests, and failed outside these ranges, which ranges were adjusted and retested until the tests were passed. This testing and adjusting ingredients to both meet and exceed the standards set by ASTM B117-11 and other ASTM tests took over a year of experimental lab testing with very fine adjustment to produce a product that when tested according ASTM-B 117-11 resulted in zero oxidation or rusting, and no rust on any of the panels. This demonstrates that in conditions under which sand and dirt would cause jamming of cartridges, no such jamming takes place.

To summarize, this synthetic lubricant, cleaner and preservative composition for weapons and weapon systems has the ability to resist premature corrosion caused by moisture and salt water while offering a micro film layer of lubricant that protects against jamming in adverse elements with the ability to resist powder flash residue. This composition has the capacity to penetrate the austenitic surface of the metal providing a lasting layer of protection against rust and corrosion caused by oxidation or harsh chemicals or carbon residue from powder flash. This impregnation of the composition into the crystalline pattern of the metal makes cleaning less of a chore. This protection remains within the austenitic surface even in the most hostile conditions. Further, when applied to gun barrels or mechanisms, the composition offers protection that is resistant the many problems encountered within the marine environment including salt spray test ASTM B 117-11 per United States Military specification MIL-PRF-63460E. It provides a protective barrier on metal and nonmetal gun barrels and components for long- or short-term preservation of weapons and weapon systems.

This composition offers a corrosion-resistant compound formulated to be effective in highly-corrosive conditions such as water, salt-embedded sand, mud and dirt. It is formulated with the ability to retard oxidation and rust while resisting the adhesive nature of the residue of spent powder and the damaging effect it can have on the inner barrel by reducing the resistance of the bullet or projectile. The composition protects metal surfaces from oxidation caused by powder flash residue and the elements especially in marine or desert applications.

In short, this composition provides unique solution being sought by the military and by sports persons. The product can be sprayed on, wicked on or swabbed, and the excess material then removed until the surface has a clean smooth feel. It retards oxidation, corrosion and chemical reaction on all types of gun barrels under adverse conditions, while extending and preserving the useful life of the weapons and/or weapon systems. Further the composition has the ability to function in temperatures well over 40 degrees C. with a flash point of well over 100 degrees C., and again, remains operational down to temperatures of minus 60 degrees C.

The knowledge possessed by someone of ordinary skill in the art at the time of this disclosure is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A synthetic lubricant, cleaner and preservative composition for weapons and weapon systems, comprising:

30 to 95 percent by volume of at least one isomer solvent selected from the solvent group consisting of: dipropylene glycol n-propyl ether; tripropylene glycol methyl ether; triethylene glycol monoethyl ether; diethylene glycol methyl ether; dipropylene glycol n-butyl ether; diethylene glycol monopropyl ether; propoxyethyl ethanol; diethylene glycol monoethyl ether; 2 butoxyethyl acetate; cellosolve carbutol; glycol phenyl ether; and 2 ethylhexyl acetate;

a calcium sulfonate comprising a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446); and at least one base oil selected from the base oil group consisting of: group I base oils; group II base oils; and group III base oils.

2. The composition of claim 1, further comprising mineral spirits.

3. The composition of claim 1, further comprising alpha-olefins.

4. The composition of claim 2, further comprising alpha-olefins.

5. The composition of claim 1, further comprising synthetic calcium sulfonates.

6. The composition of claim 2, further comprising synthetic calcium sulfonates.

7. The composition of claim 3, further comprising synthetic calcium sulfonates.

8. The composition of claim 1, further comprising at least one fluoro-additive.

9. The composition of claim 2, further comprising at least one fluoro-additive.

10. The composition of claim 3, further comprising at least one fluoro-additive.

11. The composition of claim 1, further comprising common moellen degras.

12. The composition of claim 2, further comprising common moellen degras.

13. The composition of claim 3, further comprising common moellen degras.

14. The composition of claim 1, further comprising:
alpha-olefins;
synthetic calcium sulfonates;
at least one fluoro-additive; and
common moellen degras.

15. The composition of claim 2, further comprising:
alpha-olefins;
synthetic calcium sulfonates;
at least one fluoro-additive; and
common moellen degras.

16. The composition of claim 1:
said calcium sulfonate comprising 5 to 65 percent thereof, by volume; and
said at least one base oil comprising 5 to 55 percent thereof, by volume.

17. The composition of claim 2, said mineral spirits comprising 2 to 25 percent thereof, by volume.

18. The composition of claim 3, said alpha-olefins comprising 2 to 30 percent thereof, by volume.

19. The composition of claim 5, said synthetic calcium sulfonates comprising 0.20 to 15 percent thereof, by volume.

20. The composition of claim 6, said synthetic calcium sulfonates comprising 0.20 to 15 percent thereof, by volume.

21. The composition of claim 8, said at least one fluoro-additive comprising 0.10 to 2.0 percent thereof, by volume.

22. The composition of claim 9, said at least one fluoro-additive comprising 0.10 to 2.0 percent thereof, by volume.

23. The composition of claim 11, said common moellen degras comprising 0.50 to 30 percent thereof, by volume.

24. The composition of claim 12, said common moellen degras comprising 0.50 to 30 percent thereof, by volume.

25. The composition of claim 14:
said alpha-olefins comprising 2 to 30 percent thereof, by volume;
said synthetic calcium sulfonates comprising 0.20 to 15 percent thereof, by volume;
said at least one fluoro-additive comprising 0.10 to 2.0 percent thereof, by volume; and
said common moellen degras comprising 0.50 to 30 percent thereof, by volume.

26. The composition of claim 15:
said alpha-olefins comprising 2 to 30 percent thereof, by volume;
said synthetic calcium sulfonates comprising 0.20 to 15 percent thereof, by volume;
said at least one fluoro-additive comprising 0.10 to 2.0 percent thereof, by volume; and
said common moellen degras comprising 0.50 to 30 percent thereof, by volume.

27. A method for producing a synthetic lubricant, cleaner and preservative composition for weapons and weapon systems, said method comprising:
preheating a calcium sulfonate comprising a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446) from 40 to 50 degrees C.;
preheating at least one isomer solvent selected from the solvent group consisting of: dipropylene glycol n-propyl ether; tripropylene glycol methyl ether; triethylene glycol monoethyl ether; diethylene glycol methyl ether; dipropylene glycol n-butyl ether; diethylene glycol monopropyl ether; 2 propoxyethyl ethanol; diethylene glycol monoethyl ether; 2 butoxyethyl acetate; cellosolve carbutol; glycol phenyl ether; and 2 ethylhexyl acetate to approximately 40 degrees C.;
blending said calcium sulfonate and said at least one isomer solvent into a primary blend until said primary blend is in a consistent amalgamation without any appearance of separation;
preheating at least one base oil selected from the base oil group consisting of: group I base oils; group II base oils; and group III base oils to approximately 30 degrees C.; and
blending said at least one base oil with said primary blend into a final blend until said final blend is a consistent amalgamation without appearance of separation, wherein the final blend comprises 30 to 95 percent by volume of the at least one isomer solvent.

28. The method of claim 27, further comprising:
preheating alpha olefins to approximately 30 degrees C.;
blending said at least one base oil and said alpha olefins into a secondary blend until said secondary blend is in a consistent amalgamation without any appearance of separation; and
producing said final blend by blending said secondary blend comprising said at least one base oil and said alpha olefins with said primary blend until said final blend is a consistent amalgamation without appearance of separation.

29. The method of claim 27, further comprising:
blending synthetic calcium sulfonates, at least one fluoro-additive, and common moellen degras with said final blend.

30. The method of claim 29, further comprising blending said synthetic calcium sulfonates and said common moellen degras with mineral spirits prior to blending them with said final blend.

31. The method of claim 28, further comprising:
blending synthetic calcium sulfonates, at least one fluoro-additive, and common moellen degras with said final blend.

32. The method of claim 31, further comprising blending said synthetic calcium sulfonates and said common moellen degras with mineral spirits prior to blending them with said final blend.

33. A method for producing a synthetic lubricant, cleaner and preservative composition for weapons and weapon systems, said method comprising:
preheating a calcium sulfonate comprising a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446) from 40 to 50 degrees C.;
preheating mineral spirits to about 30 degrees C.;
blending said calcium sulfonate and said mineral spirits until this blend forms an amalgamation without any appearance of separation;
allowing said calcium sulfonate and mineral spirits blend to cool to ambient temperature;
blending said calcium sulfonate and mineral spirits blend with at least one isomer solvent selected from the solvent group consisting of: dipropylene glycol n-propyl ether; tripropylene glycol methyl ether; triethylene glycol monoethyl ether; diethylene glycol methyl ether; dipropylene glycol n-butyl ether; diethylene glycol monopropyl ether; 2 propoxyethyl ethanol; diethylene glycol monoethyl ether; 2 butoxyethyl acetate; cellosolve carbutol; glycol phenyl ether; and 2 ethylhexyl acetate into a primary blend until the combined liquid is in a consistent amalgamation without any appearance of separation; and blending at least one base oil with said primary blend into a final blend until said final blend is a consistent amalgamation without appearance of separation, wherein the final blend comprises 30 to 95 percent by volume of the at least one isomer solvent.

34. The method of claim 33, further comprising:

blending said at least one base oil and said alpha olefins into a secondary blend until said secondary blend is in a consistent amalgamation without any appearance of separation; and producing said final blend by blending said secondary blend comprising said at least one base oil and said alpha olefins with said primary blend until said final blend is a consistent amalgamation without appearance of separation.

35. The method of claim 33, further comprising:

blending synthetic calcium sulfonates, at least one fluoro-additive, and common moellen degras with said final blend.

36. The method of claim 35, further comprising blending said synthetic calcium sulfonates and said common moellen degras with mineral spirits prior to blending them with said final blend.

37. The method of claim 34, further comprising:

blending synthetic calcium sulfonates, at least one fluoro-additive, and common moellen degras with said final blend.

38. The method of claim 37, further comprising blending said synthetic calcium sulfonates and said common moellen degras with mineral spirits prior to blending them with said final blend.

39. A synthetic lubricant, cleaner and preservative product-by-process for weapons and weapon systems, produced by a method comprising:

preheating a calcium sulfonate comprising a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446) from 40 to 50 degrees C.;

preheating at least one isomer solvent selected from the solvent group consisting of: dipropylene glycol n-propyl ether; tripropylene glycol methyl ether; triethylene glycol monoethyl ether; diethylene glycol methyl ether; dipropylene glycol n-butyl ether; diethylene glycol monopropyl ether; 2 propoxyethyl ethanol; diethylene glycol monoethyl ether; 2 butoxyethyl acetate; cellosolve carbutol; glycol phenyl ether; and 2 ethylhexyl acetate to approximately 40 degrees C.;

blending said calcium sulfonate and said at least one isomer solvent into a primary blend until said primary blend is in a consistent amalgamation without any appearance of separation;

preheating at least one base oil selected from the base oil group consisting of: group I base oils; group II base oils; and group III base oils to approximately 30 degrees C.; and blending said at least one base oil with said primary blend into a final blend until said final blend is a consistent amalgamation without appearance of separation, wherein the final blend comprises 30 to 95 percent by volume of the at least one isomer solvent.

40. The product-by-process of claim 39, further comprising:

preheating alpha olefins to approximately 30 degrees C.;

blending said at least one base oil and said alpha olefins into a secondary blend until said secondary blend is in a consistent amalgamation without any appearance of separation; and producing said final blend by blending said secondary blend comprising said at least one base oil and said alpha olefins with said primary blend until said final blend is a consistent amalgamation without appearance of separation.

41. The product-by-process of claim 39, further comprising:

blending synthetic calcium sulfonates, at least one fluoro-additive, and common moellen degras with said final blend.

42. The product-by-process of claim 41, further comprising blending said synthetic calcium sulfonates and said common moellen degras with mineral spirits prior to blending them with said final blend.

43. The product-by-process of claim 40, further comprising:

blending synthetic calcium sulfonates, at least one fluoro-additive, and common moellen degras with said final blend.

44. The product-by-process of claim 43, further comprising blending said synthetic calcium sulfonates and said common moellen degras with mineral spirits prior to blending them with said final blend.

45. A synthetic lubricant, cleaner and preservative product-by-process for weapons and weapon systems, produced by a method comprising:

preheating a calcium sulfonate comprising a flash point over 170 degrees C. (342 degrees F.) by way of Cleveland Open Cup, relative density 0.89 @60 15.6 degrees C. (ASTM D 4052), a melting point of 38 degrees C. (ASTM D 97), and a viscosity of 16 mm2/s @40 degrees C. (ASTM D 446) from 40 to 50 degrees C.;

preheating mineral spirits to about 30 degrees C.;

blending said calcium sulfonate and said mineral spirits until this blend forms an amalgamation without any appearance of separation;

allowing said calcium sulfonate and mineral spirits blend to cool to ambient temperature;

blending said calcium sulfonate and mineral spirits blend with at least one isomer solvent selected from the solvent group consisting of: dipropylene glycol n-propyl ether; tripropylene glycol methyl ether; triethylene glycol monoethyl ether; diethylene glycol methyl ether; dipropylene glycol n-butyl ether; diethylene glycol monopropyl ether; 2 propoxyethyl ethanol; diethylene glycol monoethyl ether; 2 butoxyethyl acetate; cellosolve carbutol; glycol phenyl ether; and 2 ethylhexyl acetate into a primary blend until the combined liquid is in a consistent amalgamation without any appearance of separation; and blending at least one base oil with said primary blend into a final blend until said final blend is a consistent amalgamation without appearance of separation, wherein the final blend comprises 30 to 95 percent by volume of the at least one isomer solvent.

46. The product-by-process of claim 45, further comprising:

blending said at least one base oil and said alpha olefins into a secondary blend until said secondary blend is in a consistent amalgamation without any appearance of separation; and producing said final blend by blending said secondary blend comprising said at least one base oil and said alpha olefins with said primary blend until said final blend is a consistent amalgamation without appearance of separation.

47. The product-by-process of claim 45, further comprising:

blending synthetic calcium sulfonates, at least one fluoro-additive, and common moellen degras with said final blend.

48. The product-by-process of claim 47, further comprising blending said synthetic calcium sulfonates and said common moellen degras with mineral spirits prior to blending them with said final blend.

49. The product-by-process of claim 46, further comprising:

blending synthetic calcium sulfonates, at least one fluoro-additive, and common moellen degras with said final blend.

50. The product-by-process of claim 49, further comprising blending said synthetic calcium sulfonates and said common moellen degras with mineral spirits prior to blending them with said final blend.

* * * * *